US007077399B2

(12) United States Patent
Yamagishi

(10) Patent No.: US 7,077,399 B2
(45) Date of Patent: Jul. 18, 2006

(54) CHIP COLLECTING MACHINE

(75) Inventor: Junichi Yamagishi, c/o Unirec Co., Ltd., 6-3, 2-chome, Kaminarimon, Taito-ku, Tokyo (JP) 111-0034

(73) Assignees: Unirec Co., Ltd., Tokyo (JP); Junichi Yamagishi, Tokyo (JP)

( * ) Notice: Subject to any disclaimer, the term of this patent is extended or adjusted under 35 U.S.C. 154(b) by 0 days.

(21) Appl. No.: 10/195,345

(22) Filed: Jul. 15, 2002

(65) Prior Publication Data

US 2004/0007813 A1 Jan. 15, 2004

(51) Int. Cl.
*A47L 9/10* (2006.01)

(52) U.S. Cl. ..... 273/148 R; 15/347

(58) Field of Classification Search ..... 273/148 R, 273/460; 15/327.1, 320, 321, 346, 353, 328, 15/347

See application file for complete search history.

(56) References Cited

U.S. PATENT DOCUMENTS

| | | | | | |
|---|---|---|---|---|---|
| 2,025,946 | A | * | 12/1935 | Wenner-Gren | 55/319 |
| 2,219,567 | A | * | 10/1940 | Spielman | 55/372 |
| 3,618,297 | A | * | 11/1971 | Hamrick | 96/406 |
| 3,979,054 | A | * | 9/1976 | Graham | 232/43.2 |
| 4,017,281 | A | * | 4/1977 | Johnstone | 55/334 |
| 4,575,895 | A | * | 3/1986 | Spellman | 15/327.1 |
| 4,746,424 | A | * | 5/1988 | Drew | 210/169 |
| 4,757,941 | A | * | 7/1988 | Hosterman et al. | 232/16 |
| 4,833,753 | A | * | 5/1989 | Muller | 15/339 |
| 4,894,881 | A | * | 1/1990 | Palmer et al. | 15/328 |
| 5,059,223 | A | * | 10/1991 | Diebolder | 55/373 |
| 5,273,561 | A | * | 12/1993 | Zeren | 96/406 |
| 5,375,293 | A | * | 12/1994 | Gilbertson | 15/339 |
| 5,388,301 | A | * | 2/1995 | Bosyj et al. | 15/327.1 |
| 5,667,080 | A | * | 9/1997 | Klein | |
| 6,081,961 | A | * | 7/2000 | Wang | 15/327.2 |
| 2002/0178696 | A1 | * | 12/2002 | Korff | |

FOREIGN PATENT DOCUMENTS

| | | |
|---|---|---|
| JP | 56-60450 | 10/1954 |
| JP | 56-176663 | 5/1955 |
| JP | 57-7451 | 6/1995 |
| JP | 8-308771 | 11/1996 |
| JP | 11-354990 | 12/1999 |
| JP | 2001-275901 | 10/2001 |

* cited by examiner

*Primary Examiner*—Vishu K. Mendiratta
(74) *Attorney, Agent, or Firm*—Jordan and Hamburg LLP

(57) ABSTRACT

A chip collecting machine includes an electric fan for sucking air; a suction chamber formed in a substantially cylindrical suction drum for air suction by the electric fan; a suction hose externally connected to and in communication with the suction chamber; and a dust separating filter supported at the upper end of the suction drum to hang downward in the suction chamber. The dust separating filter is interposed between a discharge opening of the suction hose and the electric fan. A substantially cylindrical collecting case is removably arranged outside the dust separating filter in the suction chamber. The inside of the case communicates with the discharge opening of the suction hose.

6 Claims, 5 Drawing Sheets

CHIP COLLECTING MACHINE

BACKGROUND OF THE INVENTION

1. Field of the Invention

This invention relates to a chip collecting machine for collecting chips such as medals spilled and scattered in medal game machines, for example.

2. Description of the Related Art

Medal game machines have been provided for use (See Japanese Patent Laid-open Publication Nos. 10-80572 and 10-108977).

To play with such game machines, players insert medals through slots to execute games. Winners of the games get appropriate numbers of medals payout from dispensing hoppers, and take them out from dispensing openings.

During the games, medals can fly off the dispensing hoppers for some reason and scatter inside the game machines. Medals taken out from the dispensing openings can be scattered on the floor. Medals can be left in large quantity in the hoppers or hoppers installed in medal counters or the like. Under these situations, it is a conventional manner that the medals are raked up by people in charge of the game machines, that is, collected manually.

It is a very troublesome task to rake together medals or the like scattered inside the game machines. In the case of collecting medals scattered over the floor or the like, it is also very tiresome to collect a number of medals scattered over a large area.

SUMMARY OF THE INVENTION

It is thus an object of the present invention to provide a chip collecting machine which facilitates the collection of chips such as medals scattered in game machines or on the floor.

According to a first aspect of the present invention, there is provided a chip collecting machine which comprises: an electric fan for sucking air; a suction chamber for air suction by the electric fan; a suction hose externally connected to the suction chamber in a communicating manner; a dust separating filter disposed in the suction chamber, being interposed between a discharge opening of the suction hose and the electric fan; and a collecting case demountably disposed i.e., removably arranged, outside the dust separating filter in the suction chamber, the inside of which case communicating with the discharge opening of the suction hose.

Sucking air in the suction chamber by the electric fan activated thus produces sucking force through the suction hose communicating with the suction chamber. Scattered chips sucked by the suction hose are drawn into the suction hose together with dust or the like and discharged from the discharge opening of the suction hose into the suction chamber. Since the discharge opening of the suction hose communicates with the inside of the collecting case, the chips are discharged inside the collecting case. The chips generally have a dimension larger than the dust sucked together and have some weight, and therefore fall onto the bottom of the collecting case. Air discharged from the discharge opening into the suction chamber is sucked by the electric fan through the dust separating filter, so that particulate matter such as dust are filtered by the dust separating filter. The chips accumulated on the bottom of the collecting case are very easily collected by pulling the collecting case out of the suction chamber.

According to a second aspect of the present invention, the suction chamber is formed with a suction drum in a vertical bottomed cylindrical shape; the electric fan is mounted to an upper portion of the suction drum; the dust separating filter is supported at an upper end portion of the suction drum and is formed in a bag shape hanging downward in the suction chamber; and the collecting case is formed in a vertical bottomed cylindrical shape.

Chips discharged into the collecting case are thus very easily collected at the bottom of the vertical bottomed cylinder of the collecting case. The vertical bottomed cylindrical shape of the collecting case enables the collection of a relatively large amount of chips.

According to a third aspect of the present invention, the collecting case is made from a metal mesh. Stones or the like smaller than the meshes do not accumulate inside the collecting case. If accumulate, stones or the like fall through the meshes by pulling out and shaking by hand the collecting case. This ensures the only collection of the chips.

According to a fourth aspect of the present invention, the collecting case comprises a spacer maintaining space at least between the discharge opening of the suction hose and the dust separating filter. This ensures the falling of chips discharged from the discharge opening of the suction hose onto the bottom of the collecting case for collection.

According to a fifth aspect of the present invention, the spacer is provided at an upper end of the collecting case in an inwardly protruding manner. Thus the collecting case can be drawn out by holding the spacer serving as a handle.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

With reference to the accompanying drawings, a preferred embodiment of the present invention will be described in detail below.

Figure 1:
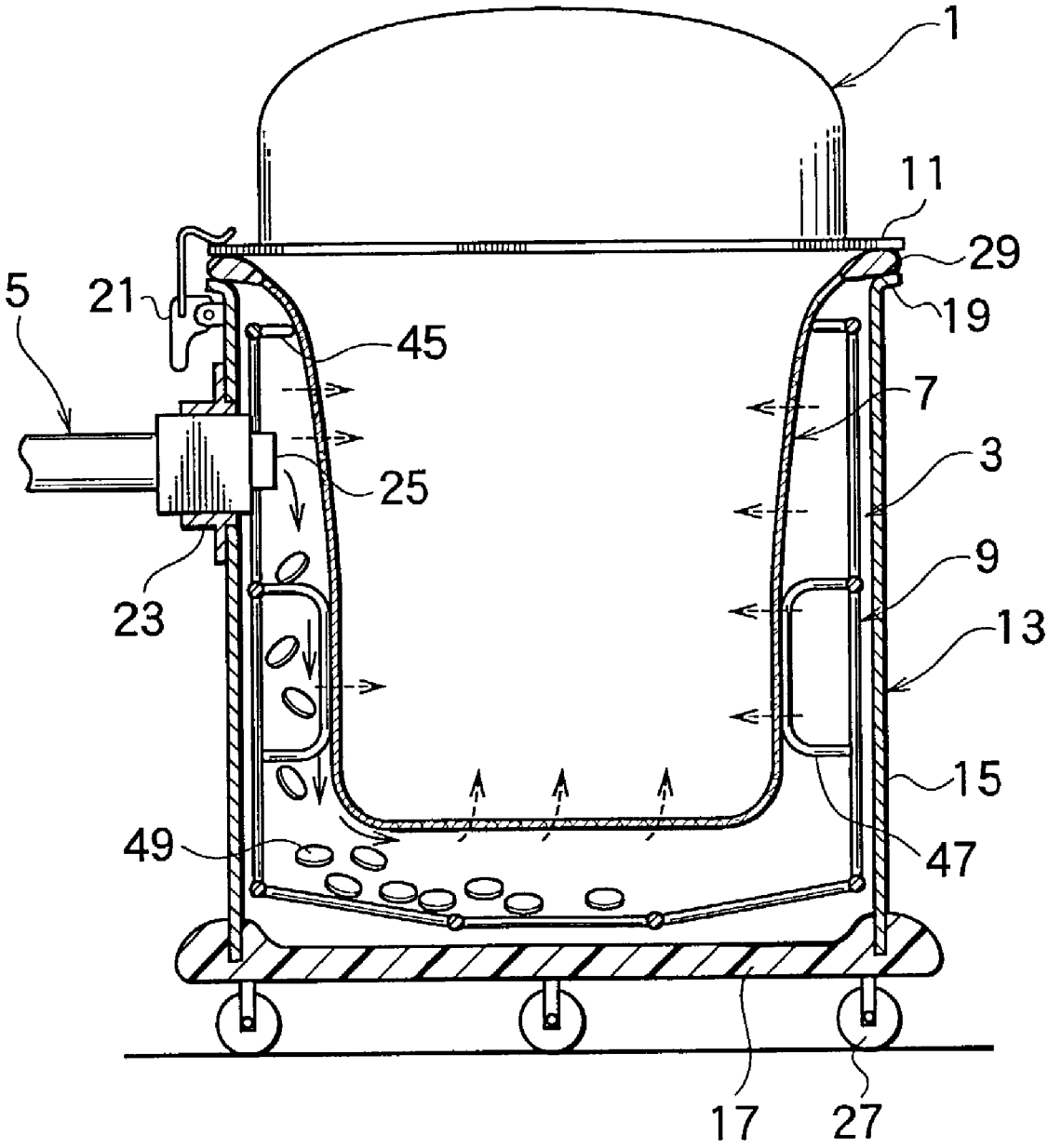
FIG. 1 is a cross-sectional view of a chip collecting machine according to an embodiment of the present invention.

FIG. 1 illustrates a cross-sectional view of a chip collecting machine according to an embodiment of the present invention. As shown in FIG. 1, the chip collecting machine includes an electric fan 1, a suction chamber 3, a suction hose 5, a dust separating filter 7, and a collecting case 9.

The electric fan 1 has a suction fan to be driven by an electric motor and a connecting flange 11 circumferentially provided at its lower end. The suction chamber 3 is formed with a suction drum 13 in a vertical bottomed cylindrical shape in this embodiment. Air inside the suction chamber 3 is sucked by the electric fan 1. The suction drum 13 has a side wall 15 made from metal and a bottom wall 17 made from resin. A flange 19 is provided at the upper end of the side wall 15, being opposite to the flange 11 of the electric fan 1. A plurality of locks 21 are provided below the flange 19. The locks 21 are circumferentially provided at the side wall 15 at predetermined intervals. The flange 11 of the electric fan 1 is disposed on the upper surface of the flange 19 and is demountably fixed by the locks 21. Thus the electric fan 1 is mounted to the upper end of the suction drum 13.

A connecting duct 23 is provided at an upper portion of the side wall 15. A suction hose 5 is detachably attached to the duct 23. A discharge opening 25 of the suction hose 5 faces the inside of the suction chamber 3. The bottom wall 17 is made from resin and is integrally connected to the side wall 15. A plurality of castors 27 are attached to the lower surface of the bottom wall 17.

The dust separating filter 7 is disposed in the suction chamber 3, being interposed between the discharge opening 25 of the suction hose 5 and the electric fan 1. Specifically, the dust separating filter 7 is made of fabric in a bag shape and is circumferentially provided with a rubber portion 29 at its upper end. The rubber portion 29 is sandwiched between the flange 19 of the suction drum 13 and the flange 11 of the electric fan 1 to provide sealing between the flanges 11 and 19. That is, the dust separating filter 7 is supported at the upper end of the suction drum 13 to hang downward inside the suction chamber 3.

The collecting case 9 is removably arranged outside the dust separating filter 7 in the suction chamber 3. The discharge opening 25 of the suction hose 5 communicates with the inside of the collecting case 9. Specifically, the collecting case 9 is substantially cylindrical in a vertical orientation and has a bottom above the bottom wall 17 of the suction drum 13.

Figure 2:
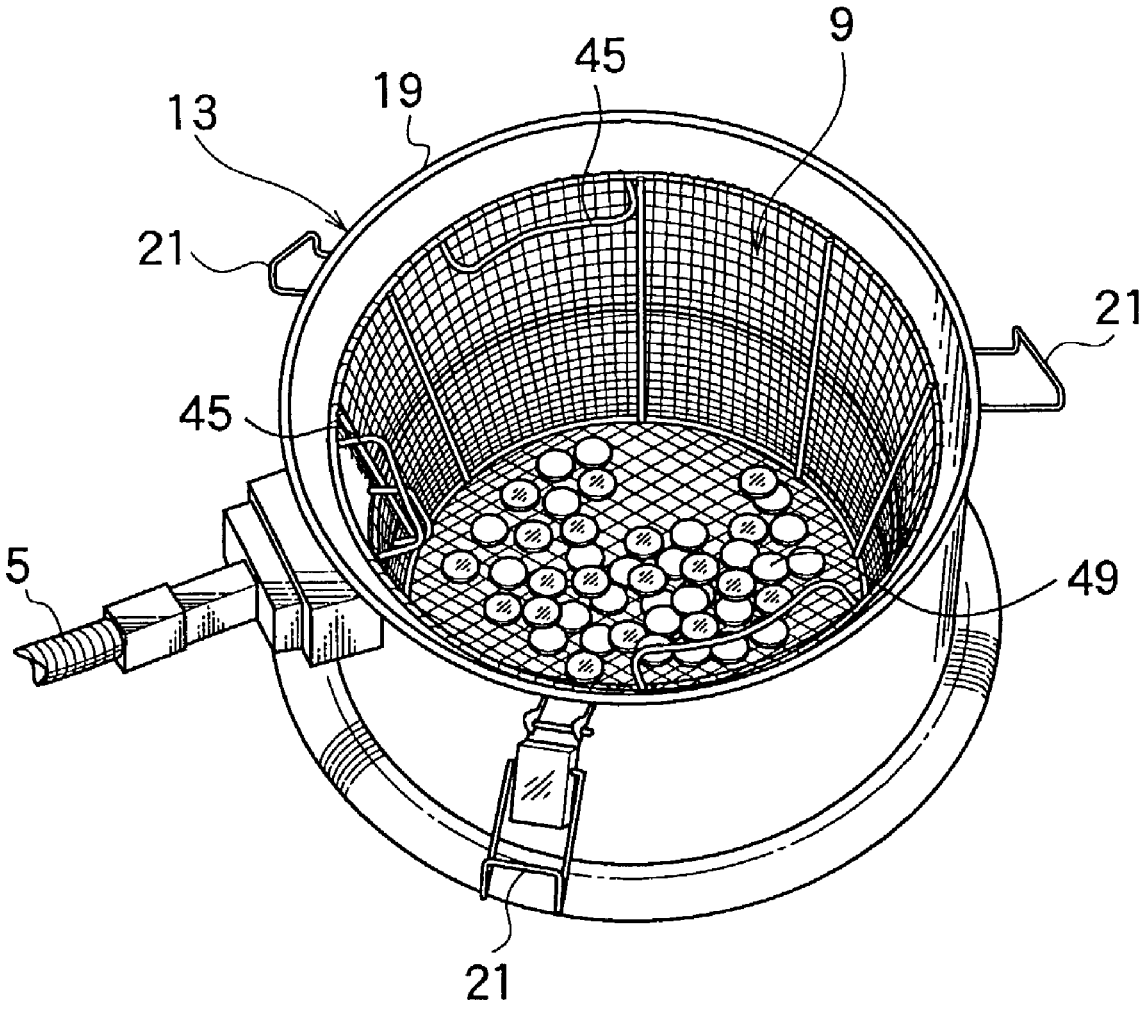
FIG. 2 is a perspective view of the chip collecting machine in FIG. 1 with an electric fan and a dust separating filter removed.
Figure 3:
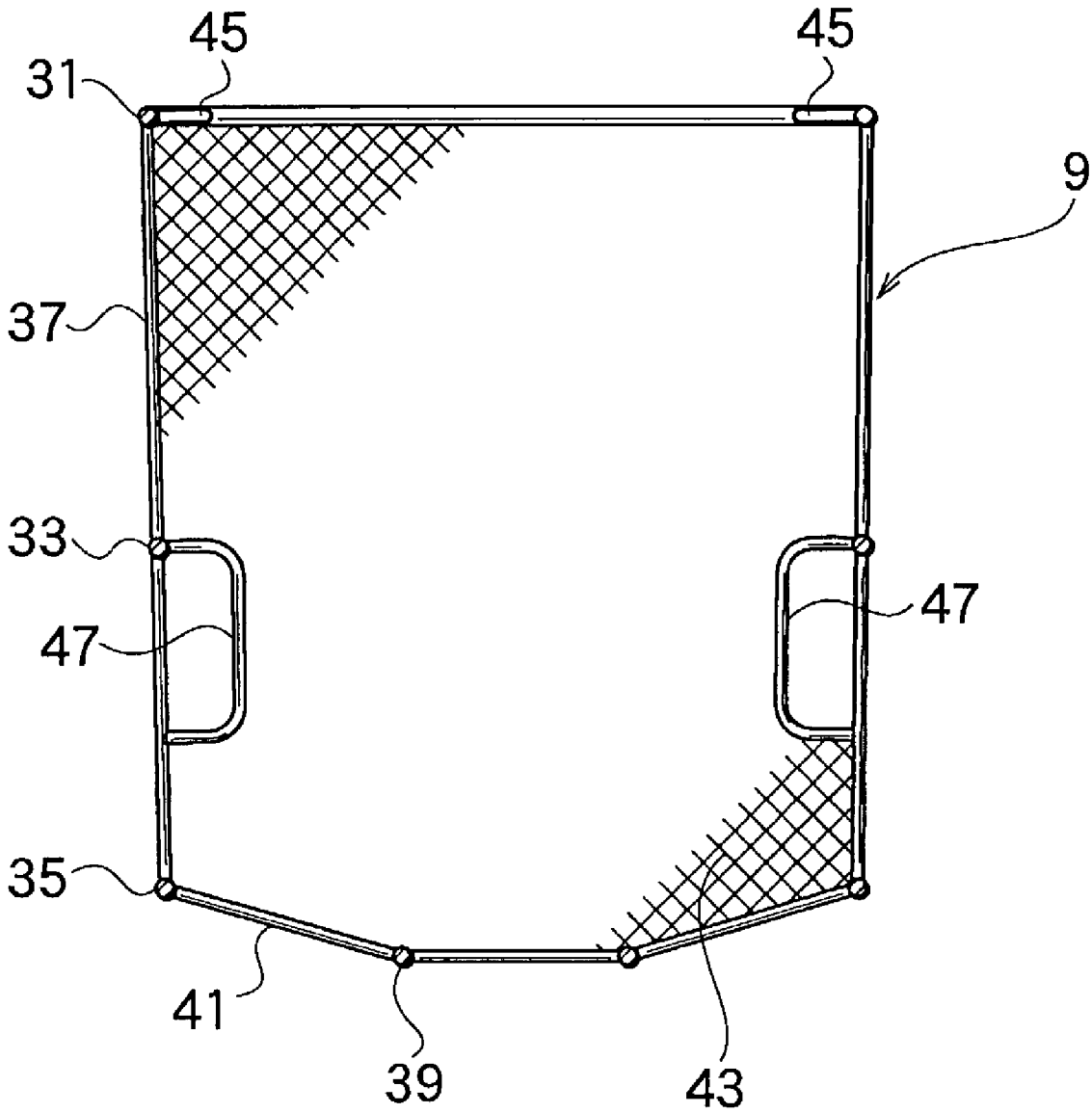
FIG. 3 is a cross-sectional view of a collecting case of the chip collecting machine in FIG. 1.
Figure 4:
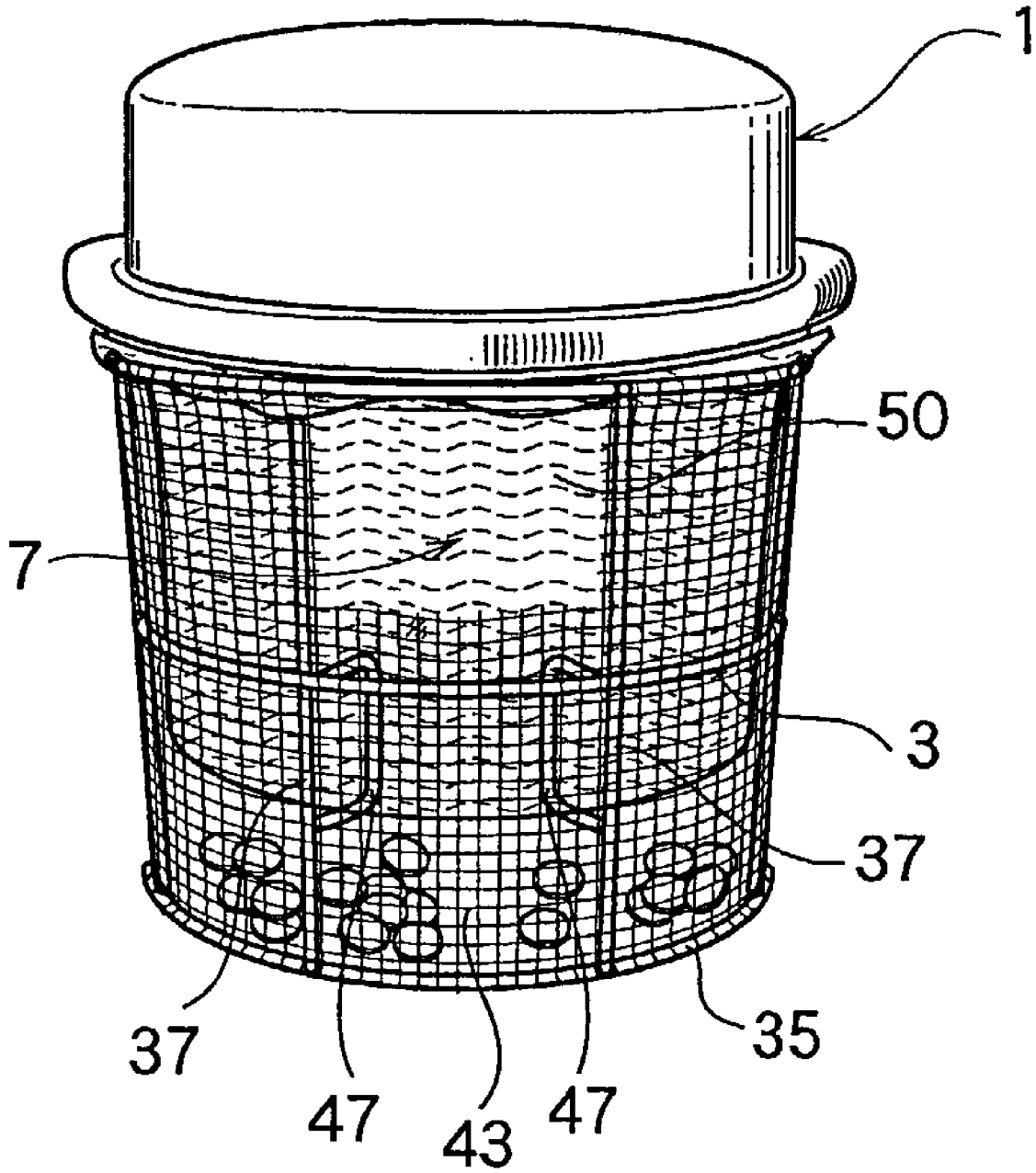
FIG. 4 is a perspective view of the chip collecting machine in FIG. 1 with a suction drum removed.
Figure 5:
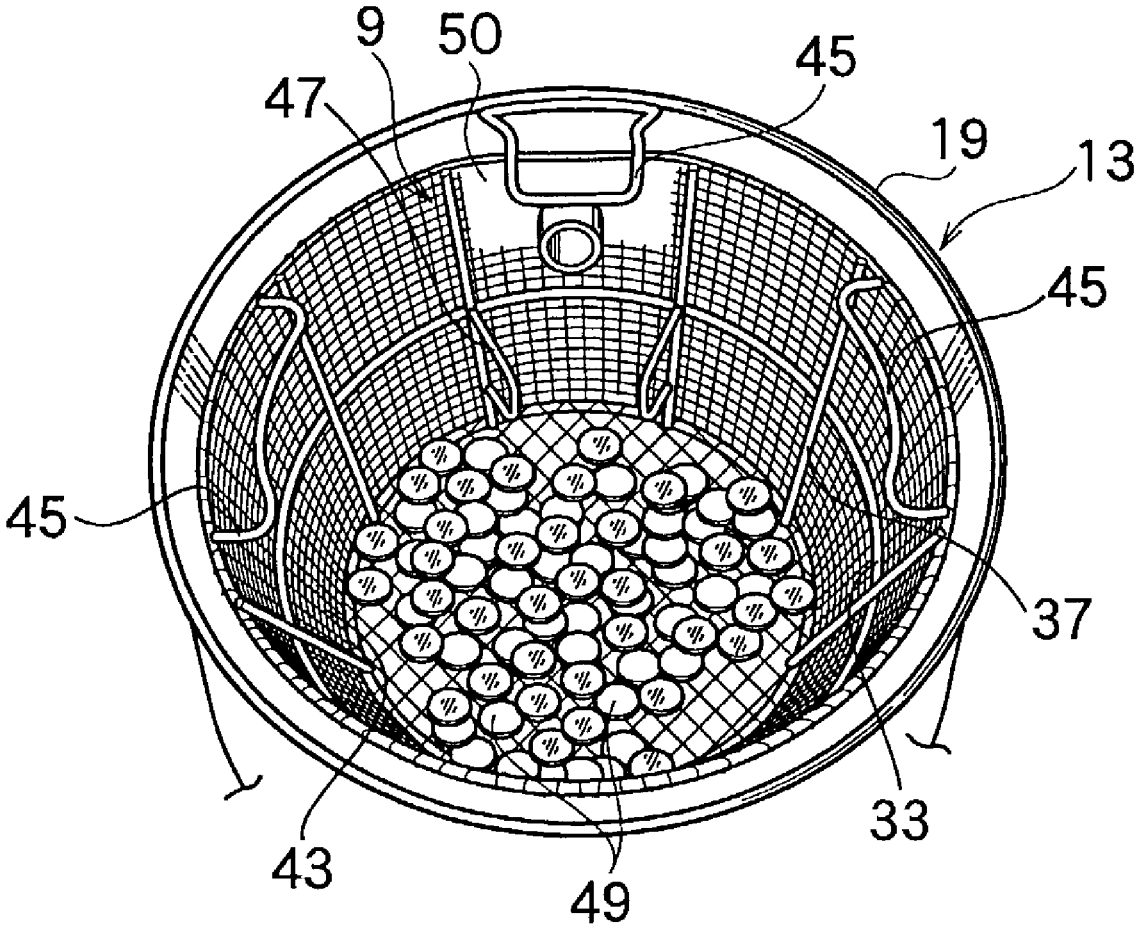
FIG. 5 is a perspective view of an essential part of the chip collecting machine in FIG. 1.

More details of the collecting case 9 will be described with reference to FIGS. 2 to 5. FIG. 2 is a perspective view showing the state where the electric fan 1 is removed. FIG. 3 is a cross-sectional view of the collecting case 9. FIG. 4 is a perspective view showing the state where the collecting case 9, dust separating filter 7 and electric fan 1 are demounted from the suction drum 13. FIG. 5 is an enlarged perspective view of an essential portion.

Referring to FIGS. 2 to 4, the collecting case 9 includes ring-shaped frames 31, 33 and 35 and a plurality of vertical frames 37 vertically connecting the ring-shaped frames 31, 33 and 35. The vertical frames 37 are provided at predetermined intervals in the circumferential direction of the ring-shaped frames 31, 33 and 35. A ring-shaped frame 39 of a small diameter is provided at the bottom. A plurality of bottom frames 41 are provided to connect the frame 39 and the frame 35. The bottom frames 41 are provided circumferentially at predetermined intervals.

A metal mesh 43 is attached to these frames 31, 33, 35, 37, 39 and 41 to form a vertical bottomed cylinder. A plurality of spacers 45 are provided to the upper end of the collecting case 9 in an inwardly protruding manner. A plurality of spacers 47 are also provided at lower side surface portions of the collecting case 9 in an inwardly protruding manner. The spacers 45 and 47 are provided circumferentially in this embodiment for maintaining space at least between the discharge opening 25 of the suction hose 5 and the dust separating filter 7. Thus the space between the collecting case 9 and the dust separating filter 7 is maintained substantially circumferentially. This facilitates the falling of medals 49 used in games as chips onto the bottom of the collecting case 9 as will be described later.

The collecting case 9 has, as shown in FIGS. 4 and 5, an opening 50 formed by removing a portion of the metal mesh 43 opposing to the connecting duct 23 of the suction drum 13. The discharge opening 25 of the suction hose 5 communicates through the opening 50 with the inside of the collecting case 9.

Next the function of the chip collecting machine of this embodiment will be described.

Upon switch-on, the electric fan 1 activated sucks air inside the suction chamber 3. This creates sucking force through the suction hose 5. The suction hose 5 sucks medals scattered inside game machines. The sucked medals are discharged together with dust or the like from the discharge opening 25 of the suction hose 5 into the suction chamber 3. The intake air is sucked through the dust separating filter 7. Dust and particulate matter are filtered by the dust separating filter 7.

The medals 49 having some dimension and weight, when discharged from the discharge opening 25, fall downward through space between the dust separating filter 7 and the collecting case 9 and accumulate on the bottom. The existence of the spacers 45 and 47 maintaining the space between the discharge opening 25 of the suction hose 5 and the dust separating filter 7 and the space between the dust separating filter 7 and the collecting case 9 substantially facilitates the falling of the medals 49 from the discharge opening 25 onto the bottom of the collecting case 9.

Stones or the like sucked together by the suction hose 5 pass through the meshes of the metal mesh 43 without accumulating on the collecting case 9.

When the medals 49 are thus collected in the collecting case 9, the locks 21 are disengaged to demount the electric fan 1 and the dust separating filter 7 as shown in FIG. 2. The spacers 45 at the upper end are used as handles to pull the collecting case 9 upward, easily demounting the case 9 from the suction drum 13.

The medals 49 are thus easily collected in the collecting case 9. Stones or the like, if left in the collecting case 9, easily fall through the meshes of the metal mesh 43 by shaking the case 9 by hand, resulting in ensured collection of only the medals 49. This significantly facilitates the collection of medals scattered in the game machines, medals left in hoppers, and medals scattered on the floor.

In this embodiment, the collecting case 9 is formed with the metal mesh 43 as the main body. Instead of a metal mesh, any material having many openings may be used to form the collecting case 9. Alternatively, without providing openings in the collecting case 9, a case of metal or a case of resin may be used. Further, the collecting case 9 is not limited to the vertical shape in its entirety and may be formed in a horizontal shape. Chips to be collected are not limited to medals. The present invention is applicable to the collection of pachinko balls, and is also applicable to the collection of chips for any purposes other than games.

What is claimed is:

1. A collecting machine which collects medals, comprising:

an electric fan for drawing air;

a housing defining a suction chamber into which the medals are drawn by said electric fan;

a suction hose connected to an exterior of said housing and communicating with said suction chamber, the medals being drawn through said suction hose into said suction chamber by said electric fan;

a dust separating filter for separating dust from the air arranged in said suction chamber and interposed between a discharge opening of said suction hose and said electric fan;

a collecting case configured from metal mesh removably arranged in said suction chamber and outside of said dust separating filter such that said dust separating fitter is arranged in an interior of said collecting case and a space is defined between said collecting case and said dust separating filter so that medals fall through said space, said collecting case having an opening formed in a side thereof and said interior in communication with said discharge opening of said suction hose through said opening in said side of said collecting case;

said discharge opening of said suction hose being exposed from said opening in said collecting case into said interior of said collecting case, facing a side of said dust separating filter front a horizontal direction, and spaced by a gap from said side face of said dust separating filter to allow medals to drop through the gap into the space between said collecting case and said dust separating filter;

an upper spacer fixedly attached and extending from an interior facing surface of said collecting case inwardly toward said separating filter front a position proximately over said opening in said collecting case so as to maintain said gap at least between said discharge opening of said suction hose and said dust separating filter;

a lower spacer extending from said interior facing surface of said collecting case inwardly toward said separating filter from a position proximately below said opening in said collecting case so as to maintain said gap at least between said discharge opening of said suction hose and said dust separating filter; and said upper spacer being configured as a handle presenting a downwardly facing surface displaced inward of said interior facing surface and sufficient for grasping to allow said collecting case to be removed upward from said suction chamber after removal of said separating filter from said suction chamber, wherein the medals discharged from said discharge opening of said suction hose downwardly drop, due to gravity, through said gap toward a bottom of said collecting case for subsequent collection.

2. A collecting machine as set forth in claim 1, wherein:

said housing comprises a substantially cylindrical suction drum in a vertical orientation;

said electric fan is mounted to an upper portion of said suction drum;

said dust separating filter is supported at an upper end portion of said suction drum and formed in a bag shape hanging downward in said suction chamber; and said collecting case has a substantially cylindrical shape in a vertical orientation.

3. A collecting machine as set forth in claim 1, wherein said suction hose is connected to an upper portion of said housing such that said discharge opening of said suction hose is arranged above a bottom of said collecting case.

4. A collecting machine as set forth in claim 1, wherein said collecting case includes a case frame having ring-shaped frames and vertical frames connecting said ring-shaped frames and said upper and lower spacers extend from said case frame.

5. A collecting machine as set forth in claim 1, wherein said collecting case includes additional lower spacers disposed at a level below said discharge opening and facing inward and extending to said separating filter and spaced circumferentially around said collecting case to maintain a substantially circumferential space between said collecting case and said dust separating filter.

6. A collecting machine as set forth in claim 1, wherein said collecting case is formed from a material having openings such that said collecting case serves to retain objects larger than said openings and allow objects smaller than said openings to drop through said material to a bottom of said housing.

* * * * *